US007053036B2

(12) United States Patent
DeGroot et al.

(10) Patent No.: US 7,053,036 B2
(45) Date of Patent: May 30, 2006

(54) COMPOSITIONS COMPRISED OF NORMAL PROPYL BROMIDE AND 1,1,1,3,3-PENTAFLUOROBUTANE AND USES THEREOF

(75) Inventors: Richard J. DeGroot, White Lake, MI (US); Ronald L. Shubkin, Baton Rouge, LA (US); Dov Shellef, Great Neck, NY (US)

(73) Assignee: Poly Systems USA, Inc., Bayonne, NJ (US)

( * ) Notice: Subject to any disclaimer, the term of this patent is extended or adjusted under 35 U.S.C. 154(b) by 333 days.

(21) Appl. No.: 10/283,713

(22) Filed: Oct. 30, 2002

(65) Prior Publication Data

US 2004/0087465 A1 May 6, 2004

(51) Int. Cl.
*C11D 7/50* (2006.01)

(52) U.S. Cl. ..... 510/410; 510/412; 510/408; 510/407; 510/365; 510/175

(58) Field of Classification Search ..... 134/40; 510/410, 411, 412, 365; 252/364; C11D 7/50, C11D 7/30; C23G 5/28
See application file for complete search history.

(56) References Cited

U.S. PATENT DOCUMENTS

| | | | | |
|---|---|---|---|---|
| 5,492,645 | A | 2/1996 | Oshima et al. | |
| 5,599,783 | A | 2/1997 | Ide et al. | |
| 5,814,595 | A | 9/1998 | Flynn et al. | |
| 5,827,812 | A | 10/1998 | Flynn et al. | |
| 5,858,953 | A | 1/1999 | Aman et al. | |
| 5,889,286 | A | 3/1999 | Barthelemy et al. | |
| 6,008,179 | A | 12/1999 | Flynn et al. | |
| 6,088,179 | A | 12/1999 | Flynn et al. | |
| 6,022,842 | A | 2/2000 | Owens et al. | |
| 6,024,785 | A | 2/2000 | Morimoto | |
| 6,048,471 | A | 4/2000 | Henry | |
| 6,048,833 | A | 4/2000 | DeGroot et al. | |
| 6,086,784 | A | 7/2000 | Barthelemy et al. | |
| 6,114,293 | A | 9/2000 | Beaver et al. | |
| 6,133,221 | A | 10/2000 | Beaver et al. | |
| 6,165,284 | A | 12/2000 | Shubkin | |
| 6,166,276 | A | 12/2000 | Sakyu et al. | |
| 6,204,237 | B1 | 3/2001 | Suzuki et al. | |
| 6,288,018 | B1 | 9/2001 | Flynn et al. | |
| 6,313,083 | B1 | 11/2001 | Flynn et al. | |
| 6,402,857 | B1 | 6/2002 | Clark et al. | |
| 6,426,327 | B1 | 7/2002 | Flynn et al. | |
| 6,770,614 | B1 * | 8/2004 | Miller et al. | 510/411 |
| 2003/0083220 | A1 | 5/2003 | Kyle et al. | |
| 2004/0171510 | A1 * | 9/2004 | Minor et al. | 510/410 |

FOREIGN PATENT DOCUMENTS

| | | |
|---|---|---|
| GB | 2270699 | 3/1994 |
| JP | 11-152236 | 6/1999 |

(Continued)

OTHER PUBLICATIONS

Handbook for Critical Cleaning; CRC Press 2001; Chapter 1.7, pp. 111-131 by Ronald L. Shubkin.

(Continued)

*Primary Examiner*—Gregory Webb
(74) *Attorney, Agent, or Firm*—Kean, Miller, Hawthorne, D'Armond, McCowan & Jarman, L.L.P.

(57) ABSTRACT

Disclosed is a composition comprised of n-propyl bromide and 1,1,1,3,3-pentafluorobutane. This invention also relates to cleaning solvent systems comprised of n-propyl bromide and 1,1,1,3,3-pentafluorobutane and methods for cleaning various solid substrates.

27 Claims, 2 Drawing Sheets

FOREIGN PATENT DOCUMENTS

| | | | |
|---|---|---|---|
| JP | 11-3263065 | | 3/2002 |
| JP | 2002241796 A | * | 8/2002 |
| WO | WO 00/56833 | | 3/2000 |

OTHER PUBLICATIONS

Handbook for Critical Cleaning; CRC Press 2001; Chapter 1,7, pp. 111-131 by Ronald L. Shubkin.

* cited by examiner

Drop Spread by Weight of nPB in nPB/HFC-365 Blend

Evaporation Times For 0.5 ml of nPB/HFC-365 Blends

COMPOSITIONS COMPRISED OF NORMAL PROPYL BROMIDE AND 1,1,1,3,3-PENTAFLUOROBUTANE AND USES THEREOF

FIELD OF THE INVENTION

This invention relates to compositions comprised of n-propyl bromide and 1,1,1,3,3-pentafluorobutane. This invention also relates to cleaning solvent systems comprised of n-propyl bromide and 1,1,1,3,3-pentafluorobutane and methods for cleaning various solid substrates.

BACKGROUND OF THE INVENTION

The cleaning of various substrates to exacting specifications has become a major consideration in the production of a wide variety of articles of manufacture. It is well known that chlorine-containing solvents are useful as cleaning agents for solid substrates, such as metals, aerospace components, medical devices, photographic and movie films, electronic and mechanical parts, molds for casting plastics, surfaces being prepared for painting, and various substrates in need of degreasing, including plastic and elastomeric surfaces. Molecular level cleaning by vapor degreasing has found a wide acceptance in the industry. In fact, molecular level cleaning by vapor degreasing is a preferred method for cleaning precision parts, such as electronics, machined metallic parts, etc., since vapor cleaning leaves virtually no residue on the parts.

While chlorine-containing solvents are technically suitable for such uses, many of them have now been banned or their use severely restricted because of environmental and/or health considerations. With the mandated elimination of the most popular chlorine-containing cleaning solvents, many manufactures have switched to other cleaning systems, such as aqueous and semi-aqueous systems. Although such systems have proved to be a viable alternative in many cleaning applications, they are not suitable for all applications. In the search to find more universal alternatives, a wide variety of new solvent cleaners were developed. While some of the new solvent cleaners are commercially successful, they still suffer from one or more deficiencies relative to the overall cost/performance of the chlorinated materials they replaced. For example, some of the newer solvents, such as some hydrofluorocarbons (HFCs) have been shown to meet environmental and toxicological requirements, but do not meet the highest performance standards.

The need in specialized applications for a non-chlorinated high-performance cleaning agent that could be used in a safe and efficient manner has led to the development of cleaning systems based on the solvent normal-propyl bromide (n-propyl bromide or nPB). The use of n-propyl bromide has met with some degree of commercial success. Its advantages include its effectiveness as a cleaning solvent, as well as its moderate cost, non-flammability, and low ozone depletion potential. Nevertheless, for some applications, n-propyl bromide is considered too aggressive because it has a tendency to swell and even dissolve certain plastics and elastomers. Attempts to tone-down its aggressiveness by blending it with at least one other solvent has generally led to expensive blends (with hydrofluoroethers) or flammable blends (with hydrocarbons). Therefore, there exists a need in the art for ways to mitigate the aggressiveness of n-propyl bromide without substantially reducing its effectiveness as a superior cleaning agent.

SUMMARY OF THE INVENTION

In accordance with the present invention, there is provided a composition comprised of n-propyl bromide and 1,1,1,3,3-pentafluorobutane.

In a preferred embodiment the composition comprises about 1 to 99 wt. % n-propyl bromide and about 99 to about 1 wt. % 1,1,1,3,3-pentafluorobutane.

In another preferred embodiment there is provided a cleaning solvent system comprised of n-propyl bromide, 1,1,1,3,3-pentafluorobutane and up to about 20 wt. % of an additive selected from the group consisting of acid acceptors, metal passivators, stabilizing agents, surface-active agents.

In another preferred embodiment the amount of n-propyl bromide in the cleaning solvent system is from about 10 to 90 wt. % n-propyl bromide and the amount of 1,1,1,3,3-pentafluorobutane is from about 90 to about 10 wt. %.

In yet another preferred embodiment of the present invention there is provided a method for vapor degreasing a solid substrate by contacting the solid substrate with a vapor phase composition comprised of n-propyl bromide and an effective amount of 1,1,1,3,3-pentafluorobutane.

In still another preferred embodiment there is provided a method for cleaning a solid substrate by contacting the solid substrate with a liquid phase composition comprised of n-propyl bromide and an effective amount of 1,1,1,3,3-pentafluorobutane.

In another preferred embodiment the solid substrate that is contacted with the liquid phase composition is selected from polymeric substrates, metallic substrates, electronic circuit boards and photographic and movie film.

DETAILED DESCRIPTION OF THE INVENTION

Figure 1:
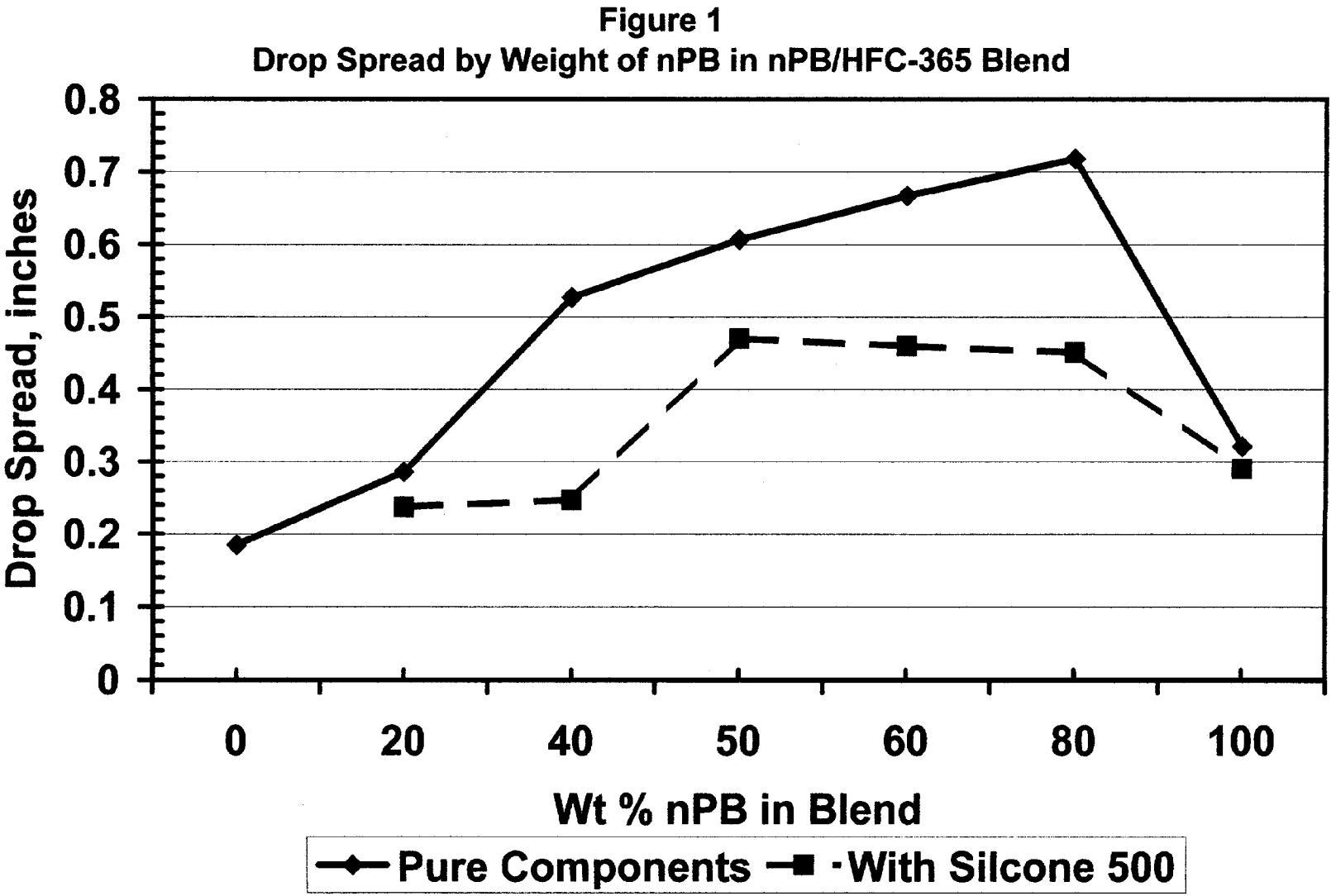
FIG. 1 is a plot of the drop spread data for Examples 1 and 2 hereof.

The present invention, in the broadest sense, relates to a composition comprised of a mixture of n-propyl bromide and 1,1,1,3,3-pentafluorobutane. A mixture of these two solvents exhibits unexpected properties when compared with each of the solvents alone. That is, a synergistic and unexpected relationship exists between these two solvents so that the whole is greater than the sum of the two solvents. In other words, the two solvents together produce combined properties greater than the sum of their separate properties. For example, the ability of a blend of these two solvents to wet a surface is superior to that of either of the individual solvents. Also, a blend of these two solvents has an evaporation rate greater than the evaporation rate of each of the solvents. It will be understood that the terms mix and blend are used interchangeably herein.

The present invention also relates to a solvent cleaning composition comprised of a mixture of n-propyl bromide and 1,1,1,3,3-pentafluorobutane. An effective ratio of each component is chosen depending on the intended cleaning application of the blend. In general, the blend compositions of the present invention will be comprised of about 1 to 99 wt. % n-propyl bromide and from about 99 to about 1 wt. % 1,1,1,3,3-pentafluorobutane, preferably from about 20 to 80 wt. % n-propyl bromide and from about 80 to about 20 wt.

% 1,1,1,3,3-pentafluorobutane, more preferably from about 30 to 70 wt. % n-propyl bromide and from about 70 to about 30 wt. % 1,1,1,3,3-pentafluorobutane, and most preferably 50 wt. % n-propyl bromide and 50 wt. % 1,1,1,3,3-pentafluorobutane.

As previously mentioned, the ratio of one solvent to the other is dependent on the intended use of the blend. If the solvent blend is to be used in the liquid phase (such as a cold cleaning application), then the n-propyl bromide should be blended with an effective amount of 1,1,1,3,3-pentafluorobutane. By effective amount we mean an amount of 1,1,1,3,3-pentafluorobutane that will not significantly decrease the cleaning properties of n-propyl bromide while lessening the possibility of damage to the substrate to be cleaned, particularly if the substrate is a plastic or elastomeric component. This may be as little as 10 wt % or as much as 90 wt % 1,1,1,3,3-pentafluorobutane. More likely, the range will be between about 30 wt % and 70 wt % 1,1,1,3,3-pentafluorobutane, with the balance being n-propyl bromide. If, however, the intended use is in the vapor phase (such as in a vapor degreaser), than the vapor-liquid equilibrium of the solvent blend must be considered. For instance, a liquid blend containing only 10 wt % 1,1,1,3,3-pentafluorobutane will boil at 136° C. and will contain about 56 wt % 1,1,1,3,3-pentafluorobutane in the vapor phase. A liquid blend containing only 20 wt % 1,1,1,3,3-pentafluorobutane will boil at 124° C. and will contain about 66 wt % 1,1,1,3,3-pentafluorobutane in the vapor phase. Thus, a relatively small concentration of 1,1,1,3,3-pentafluorobutane in n-propyl bromide in the liquid phase can have a significant effect in ameliorating the aggressive behavior of the n-propyl bromide toward plastics and elastomers when the solvent blend is used for cleaning in the vapor phase. The above weight percents of n-propyl bromide and 1,1,1,3,3-pentaflurorbutane are based on the total weight of both of these components absent any additives.

1,1,1,3,3-pentafluorobutane appears particularly advantageous for blending with n-propyl bromide from an environmental point of view since it has a substantially zero destructive potential towards ozone, primarily because chlorine is absent from its molecular structure.

Various additives can optionally be present in the compositions of the present invention. Non-limiting examples of such additives include acid acceptors, metal passivators, stabilizing agents, surface-active agents as well as any other additive suitable for the intended use of the blend composition. This makes it possible to improve the behavior of the compositions of the present invention during use. The nature and amount of such additives that are used are dependent on the particular use, and both are within the ordinary skill of those in the art. As a general rule, the total amount of additives used in the compositions of the present invention will not exceed about 20% of the weight of the final composition, most often not more than about 10 wt. %. The amount of additive, if used, will typically be from about 0.1 wt. %, preferably from about 0.5 wt. %, more preferably from about 1 wt. % up to about 20 wt. %, and preferably up to about 10 wt. %.

Because n-propyl bromide can hydrolyze or dehydrohalogenate to form hydrogen bromide, it is preferred that one of the additives be an acid acceptor. More preferably, an epoxide is used for this purpose. Non-limiting examples of suitable epoxides include butylene oxide, propylene oxide, epichlorohydrin, cyclohexene oxide, pentene oxide and cyclopentene oxide. If used, epoxides will normally be present in the range from about 0.1 wt % to 2.0 wt %, preferably from about 0.25 wt % to 1.5 wt %.

Ethers may be used as metal passivators in the blend formulations of the present invention. Non-limiting examples of such ethers include 1,2-dimethoxymethane, 1,4-dioxane, 1,3-dioxolane, diethyl ether, diisopropyl ether and trioxane. Ethers may be used singly or in combination, preferably in amounts of about 1 wt % to 5 wt %.

Nitroalkanes may also be used in the blend formulations of the present invention as metal passivators. Non-limiting examples include nitromethane, nitroethane, 1-nitropropane and 2-nitropropane. Nitroalkanes may be used singly or in combination, preferably in amounts of about 0.1 wt % to 2 wt %.

Other additives may also be included as stabilizers or performance enhancers in the formulation of blends of the present invention. In particular, certain amines, nitriles and alcohols may be used. Non-limiting examples of suitable amines include hexylamine, isohexylamine, octylamine, isooctylamine, dipropylamine, diisopropylamine, dibutylamine, diisobutylamine, tripropylamine, triisopropylamine, and N,N-dimethylcyclohexylamine. Non-limiting examples of suitable nitrites include acetonitrile, propionitrile, and butyronitrile. Non-limiting examples of suitable alcohols include n-propanol, isopropanol, n-butanol, isobutanol and tert.-butanol.

The compositions of the present invention can be used for a variety of cleaning applications. For example they can be used in vapor degreasing, which is sometimes referred to as molecular vapor degreasing. Vapor degreasing is typically used to clean precision parts, such as electronics, machined metallic parts, etc. Vapor degreasing generally involves the heating of a solvent to its boiling point to generate a vapor layer into which the object to be cleaned is placed. Vapor condenses on the object and subjects its surface to a solvent-washing action as it flows downward. The solvent-washing action dissolves any contaminants and removes them from the object, thereby cleaning it. Condensed drops of liquid are then collected in a reservoir and revaporized, typically by the use of steam-heating coils. Thus, the surface of the object is continually washed with fresh solvent. The solvent compositions of the present invention are non-azeotropic and thus they have the advantage in that the composition of the vapor phase can be controlled with respect to the desired amount of n-propyl bromide to the amount of 1,1,1,3,3-pentafluorobutane.

There are four general types of vapor phase degreasing. The simplest form of vapor phase degreasing is straight vapor cycle degreasing that utilizes only the vapor for cleaning. As the parts are lowered into the hot vapor, the vapor condenses on the cold parts and dissolves surface oils and greases. The oily condensate drops back into the liquid solvent at the base of a solvent holding tank. The solvent is continuously evaporated to form a vapor blanket. Since the oils are not vaporized, they remain dissolved in the solvent in the tank or at the bottom of the tank in the form of a sludge. The washing action of the condensing vapor continues until the temperature of the part reaches the temperature of the vapor whereupon condensation ceases and the part appears dry and is removed from the degreasing operation. The time required to reach this point depends on such things as the particular solvent employed, the temperature of the vapor, the weight of the part, its specific heat and the type of contamination material to be removed. This particular type of vapor phase degreaser does an excellent job of drying parts after aqueous cleaning and before plating and, thus, it is frequently used for this purpose in the jewelry industry. Unfortunately, straight vapor cycle degreasing is not as effective on small, light-weight parts because such parts frequently reach the temperature of the vapor before the condensing solvent action has fully cleaned the parts.

A second type of vapor phase degreasing is referred to as vapor-spray cycle degreasing. Vapor-spray cycle degreasing is frequently used to solve problems associated with straight vapor cycle degreasing. In vapor-spray cycle degreasing, the part to be cleansed is first placed in the vapor zone, as is done in straight vapor cycle degreasing. A portion of the vapor is condensed by use of cooling coils and fills a liquid solvent reservoir. Warm liquid solvent is pumped through a spray nozzle which sprays it directly onto the part to be degreased, thus washing off surface oils and cooling the part.

A third type of vapor phase degreasing is liquid-vapor cycle degreasing which typically has one compartment containing refluxing solvent and another compartment comprising somewhat cooler solvent condensate. The second compartment is referred to as the rinse sump. A vapor zone is maintained over the refluxing solvent. In this type of degreasing operation, the parts to be cleaned are first suspended in the vapor zone until condensation of vapor on the parts ceases. Next, the parts are lowered into the refluxing solvent in the first compartment. After a suitable period of time, the parts are removed to the rinse sump. Finally, the parts are again placed in the vapor zone until dry. This type of degreasing is particularly useful for heavily soiled parts or for cleaning a basket of small parts that are nested together.

A fourth type of vapor phase degreasing is ultrasonic degreasing. Ultrasonic degreasing is useful for cleaning critical parts and typically uses a transducer mounted at the base of the solvent tank and operates in the range of 20 to 40 kHz. The transducer alternately compresses and expands the solvent thereby forming small bubbles that, in turn, cavitate or collapse on the surface of the part. This cavitation phenomenon disrupts the adhering contaminants, thereby cleaning the part.

It has been discovered, by the inventors hereof, that the solvent mixture of the present invention meets the desired characteristics for the effective cleaning of a variety of substrates, including those previously mentioned herein. More particularly, the solvent mixture of the present invention has the following characteristics: (1) it may be substantially stabilized against; a) free acids that may result from hydrolysis of the mixture in the presence of moisture, and b) decomposition on the surface of metals; (2) it is substantially non-flammable and non-corrosive; (3) the various components of the solvent mixture are free from regulation by the U.S. Clean Air Act; and (4) none of the various components of the solvent mixture are known cancer causing agents (i.e., the various components are not listed by N.T.I., I.A.R.C. and California Proposition 65, nor are they regulated by OSHA). In addition, the solvent mixture of the present invention has an evaporation rate greater than that of each of the two individual components. This ensures rapid drying which is essential to any economical cleaning process. This increased evaporation rate is also advantageous if the solvent composition is to be used in the deposition of thin films. For example, silicone oil is often applied as a thin film on hypodermic needles to provide lubrication, thus minimizing pain. One problem typically encountered in depositing silicone oil to a hypodermic needle is the undesirable formation of a drop of silicone oil at the end of the needle. Rapid drying of the deposition composition will help to prevent such a drop from forming. The blend compositions of the present invention also unexpectedly exhibit superior spreadability when compared to n-propyl bromide or 1,1,1,3,3-pentafluorobutane alone. This helps ensure a thin uniform film during deposition, and also helps prevent the formation of a drop of silicone oil at the end of the hypodermic needle being treated.

As a result of the foregoing properties, the solvent mixture of the present invention can be advantageously used in vapor phase degreasing, as well as in other cleaning operations, in place of traditional solvents including, for example, trichlorethylene, perchloroethylene, methyl chloroform, methylene chloride, trichlorotrifluoroethane, CFC-113, etc.

The solvent compositions of the present invention can be prepared by combining and mixing together the desired amount of n-propyl bromide and the desired amount of 1,1,1,3,3-pentafluorobutane. As previously mentioned, the desired amount of each component with respect to the other component, is chosen depending on the intended use of the final blend composition. The solvent compositions of the present invention can also be used in other cleaning applications. Non-limiting examples of such other cleaning applications include their use in cold cleaning, in hand wipes, in aerosols and sprays, and in line flushing (refrigeration coils, oxygen lines, etc.). They can also be used to clean substrates such as electronic circuit boards, polymeric substrates including plastics, elastomers, and photographic and movie film. The compositions of the present invention can also be used in applications other than cleaning. As previously mentioned they can also be used as deposition fluids, for example to deposit silicone fluids on hypodermic needles, to deposit lubricating oils in very small and inaccessible places, to deposit paints and varnishes, and to deposit glues.

n-Propyl bromide is commercially available from a variety of sources. n-Propel bromide can also be readily synthesized using known synthetic procedures. For example, it can be prepared from the reaction of alcohols with either inorganic acid bromides or with hydrogen bromide. (see, e.g., Carl R. Noller, Textbook of Organic Chemistry. Ch6:81 (1956), the teaching of which is incorporated herein by reference).

Blends of n-propyl bromide and 1,1,1,3,3-pentafluorobutane build on each other's strengths while limiting or eliminating the weaknesses of each solvent. In applications where n-propyl bromide is too aggressive in its solvating characteristics, 1,1,1,3,3-pentafluorobutane will moderate this behavior. Conversely, in sensitive cleaning applications where 1,1,1,3,3-pentafluorobutane is not capable of adequate cleaning performance, a blend of n-propyl bromide and 1,1,1,3,3-pentafluorobutane can be tailored to give the desired cleaning performance without adversely attacking the substrates being cleaned. While 1,1,1,3,3-pentafluorobutane is flammable, blends of n-propyl bromide and 1,1,1,3,3-pentafluorobutane are non-flammable. Also, very rapid drying can be achieved because it has unexpectedly been found that blends of the two solvents volatilize faster then either solvent alone. Further, blends of the two solvents demonstrate better spreadability on surfaces than either solvent alone. This characteristic allows for faster penetration into small openings and blind holes. In addition to the advantages in critical cleaning applications, rapid drying and low surface tension make these blends ideal for use as deposition fluids.

The invention will be described in greater detail by way of specific examples. The following examples are offered for illustrative purposes, and are intended neither to limit nor define the invention in any manner.

EXAMPLE 1

The spreadability of various blends of n-propyl bromide (nPB) and 1,1,1,3,3-pentafluorobutane (HFC365) was measured by drop size experiments. A drop of each blend was applied to a clean stainless steel surface and the size of the drop on the surface was measured after spreading. Table 1 below, and FIG. 1 hereof, show the results of these experiments.

TABLE 1

| % nPB | Spread of Drop (inches) |
|---|---|
| 100 | 0.321 |
| 80 | 0.718 |
| 60 | 0.667 |
| 50 | 0.607 |
| 40 | 0.527 |
| 20 | 0.286 |
| 0 | 0.185 |

EXAMPLE 2

Example 1 above was repeated except Silicone 500 was added to the blend. The results are shown in Table 2 below and in FIG. 1 hereof.

TABLE 2

| Wt. % nPB | Wt. % Silicone | Spread of Drop (inches) |
|---|---|---|
| 100 | 3.21 | 0.29 |
| 80 | 3.03 | 0.451 |
| 60 | 3.09 | 0.46 |
| 50 | 3.14 | 0.47 |
| 40 | 3.23 | 0.247 |
| 20 | 3.15 | 0.237 |

The data in Tables 1 and 2 above and FIG. 1 evidences unexpected properties of various blends of n-propyl bromide and 1,1,1,3,3-pentafluorobutane compared to each of these components alone. The data of Table 2 demonstrates that this phenomenon will remain in use for cleaning an oil-containing substrate. These experiments have strong implications concerning the ability of the blends of the present invention to wet surfaces and to penetrate small cracks, crevices and blind holes. In a cleaning application, this means that these blends will wet and begin cleaning a surface more quickly than either component alone. It also means that a blend of the present invention will be able to penetrate small openings and crevices more rapidly than either component alone. This can be very important in critical cleaning applications, especially in the aerospace industry and in electronic circuit boards where the trend is toward ever more demanding miniaturization of components.

EXAMPLE 3

Figure 2:
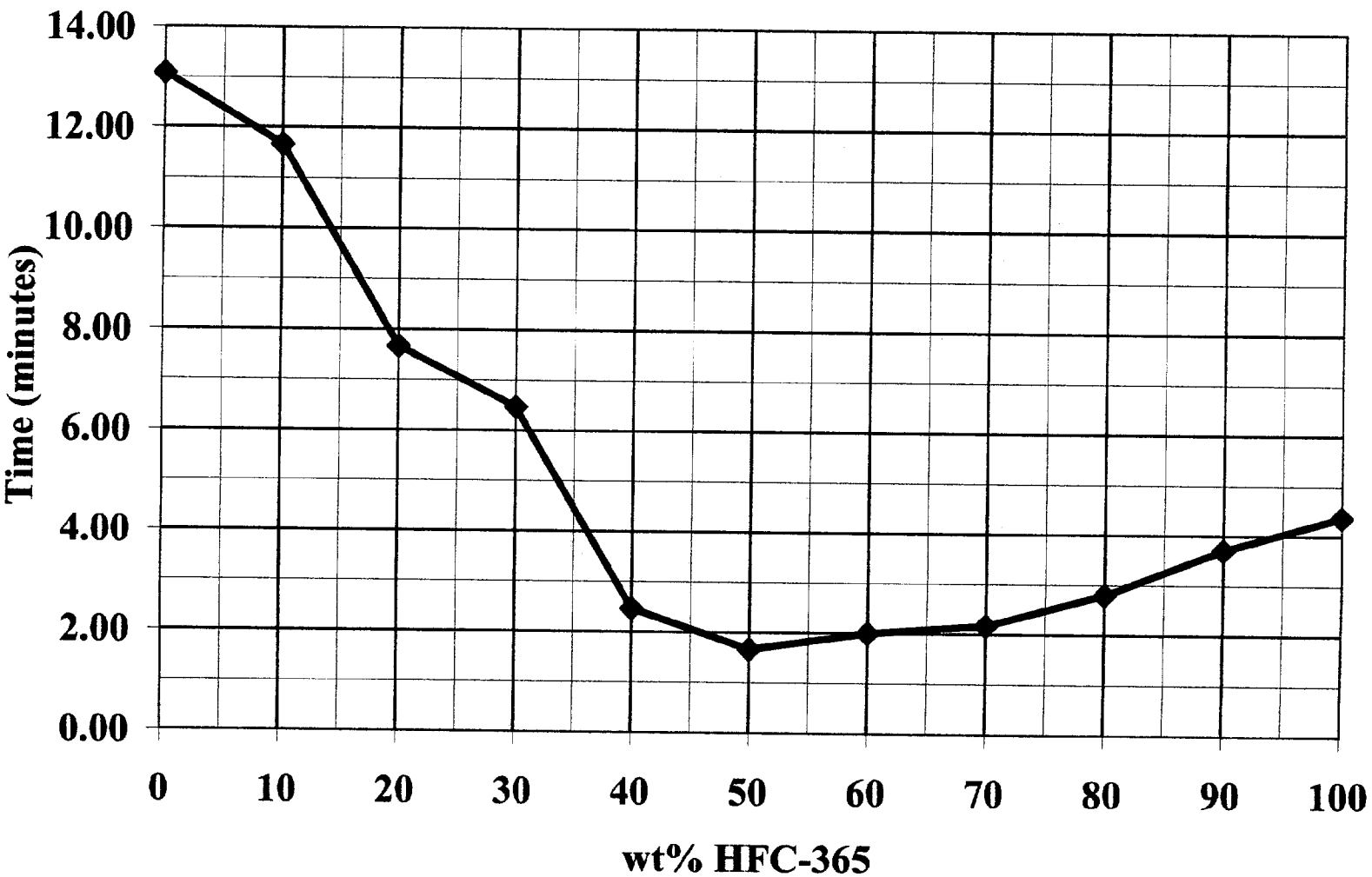
FIG. 2 is a plot of the evaporation data for Example 3 hereof.

One half ml samples of various blends of n-propyl bromide and 1,1,1,3,3-pentafluorobutane were placed on a watch glass and the evaporation rate of each was measured. Table 3 below, and FIG. 2 hereof, contains the data for these samples.

TABLE 3

Evaporation Rate of nPB/HFC365 Blends

| % HFC365 | Time |
|---|---|
| 100 | 4.37 |
| 90 | 3.70 |
| 80 | 2.80 |
| 70 | 2.17 |
| 60 | 2.00 |
| 50 | 1.67 |
| 40 | 2.47 |
| 30 | 6.47 |
| 20 | 7.67 |
| 10 | 11.67 |
| 0 | 13.08 |

The above data evidences the synergistic properties of a blend of these two solvents when compared to each individually. For example, 1,1,1,3,3-pentafluorobutane, with a boiling point of only 40.2° C. evaporates much more rapidly than n-propyl bromide, which has a boiling point of 71° C., but surprisingly blends of both of these solvents have even faster evaporation rates.

What is claimed is:

1. A composition comprised of n-propyl bromide and 1,1,1,3,3-pentafluorobutane, and a nitrile.

2. The composition of claim 1 wherein there is present about 5 to 95 wt. % n-propyl bromide and from about 95 to about 5 wt. % 1,1,3,3-pentafluorobutane.

3. The composition of claim 2 wherein there is present about 10 to 90 wt. % n-propyl bromide and from about 90 to 10 wt. % 1,1,1,3,3-pentafluorobutane.

4. The composition of claim 1 wherein there is also present and effective amount of one or more additives selected from the group consisting of acid accepters, metal passivators, stabilizing agents, and surface-active agents.

5. The composition of claim 4 wherein the acid acceptor is present and is an epoxide.

6. The composition of claim 5 wherein the epoxide is selected from the group consisting of butylene oxides, propylene oxide, epichlorohydrin, chclohexene oxide, pentene oxide, and cyclopentene oxide.

7. The composition of claim 6 wherein the metal passivator is selected from the group consisting of ethers and nitroalkanes.

8. The composition of claim 7 wherein the metal passivator is an ether selected from the group consisting of 1,2-dimethoxymethane, 1,4-dioxane, 1,3-dioxolane, diethyl ether, diisopropyl ether and trioxane.

9. The composition of claim 7 wherein the metal passivator is a nitroalkane selected from the group consisting of nitromethane, nitroethane, 1-nitropropane and 2-nitropropane.

10. The composition of claim 1 that also contains an effective amount of an additive selected from amines, and alcohols.

11. The composition of claim 10 wherein the additive is an amine selected from the group consisting of hexylamine, isohexylamine, octylamine, isooctylamine, dipropylamine, diisopropylamine, dibutylamine, diisobutylamine, tripropylamine, triisopropylamine, and N,N-dimethylcyclohexylamine.

12. The composition of claim 1 wherein the nitrile is selected from the group consisting of acetonitrile, propionitrile, and butyronitrile.

13. The composition of claim 12 wherein the additive is an alcohol selected from the group consisting of n-propanol, isopropanol, n-butanol, isobutanol and tert.-butanol.

14. A method for cleaning an organic contaminant from the surface of a solid substrate, which method comprises contacting said solid substrate at effective conditions with an effective amount of a solvent mixture comprised of about 5 to 95 wt. % n-propyl bromide and from about 95 to 5 wt. % 1,1,1,3,3-pentafluorobutane, and a nitrile.

15. The method for cleaning of claim 14 which is selected from vapor degreasing, cold cleaning, hand wipes, aerosols and sprays.

16. The method of claim 14 wherein said mixture also contains an effective amount of one or more additives selected from the group consisting of acid accepters, metal passivators, stabilizing agents, and surface-active agents.

17. The method of claim 16 wherein an acid acceptor is present, which acid acceptor is an epoxide.

18. The method of claim 17 wherein the epoxide is selected from the group consisting of butylene oxides, propylene oxide, epichlorohydrin, chelohexene oxides pentene oxide, and cyclopentene oxide.

19. The method of claim 16 wherein the metal passivator is selected from the group consisting of ethers and nitroalkanes.

20. The method of claim 19 wherein the metal passivator is an ether selected from the group consisting of 1,2-dimethoxymethane, 1,4-dioxane, 1,3-dioxolane, diethyl ether, diisopropyl ether and trioxane.

21. The method of claim 19 wherein the metal passivator is a nitroalkane selected from the group consisting of nitromethane, nitroethane, 1-nitropropane and 2-nitropropane.

22. The method of claim 14 that also contains an effective amount of an additive selected from amines, and alcohols.

23. The method of claim 14 wherein the additive is an amine selected from the group consisting of hexylamine, isohexylamine, octylamine, isooctylamine, dipropylamine, diisopropylamine, dibutylamine, diisobutylamine, tripropylamine, triisopropylamine, and N,N-dimethylcyclohexylamine.

24. The method of claim 14 wherein the nitrile is selected from the group consisting of acetonitrile, propionitrile, and butyronitrile.

25. The method of claim 22 wherein the additive is an alcohol selected from the group consisting of n-propanol, isopropanol, n-butanol, isobutanol and tert-butanol.

26. The method of claim 14 wherein the solid substrate is comprised of a material selected from the group consisting of one or more metals, glass, or polymeric material or a combination thereof.

27. The method of claim 26 wherein the solid substrate is photographic or movie film.

* * * * *